US005137215A

United States Patent [19]

Degli

[11] Patent Number: 5,137,215

[45] Date of Patent: Aug. 11, 1992

[54] CENTRIFUGAL DEVICE FOR ATOMIZING A COATING PRODUCT, PARTICULARLY FOR APPLICATION BY ELECTROSTATIC SPRAYING

[75] Inventor: Gérard Degli, Uriage, France

[73] Assignee: Sames S.A., Meylan, France

[21] Appl. No.: 690,269

[22] Filed: Apr. 24, 1991

[30] Foreign Application Priority Data

Apr. 24, 1990 [FR] France ..... 90 05203

[51] Int. Cl.[5] ..... B05B 3/10; B05B 5/04

[52] U.S. Cl. ..... 239/223; 239/703

[58] Field of Search ..... 239/700, 701, 702, 703, 239/223, 224, 112

[56] References Cited

U.S. PATENT DOCUMENTS

| | | | |
|---|---|---|---|
| 3,749,315 | 7/1973 | Crathern | 239/224 |
| 4,275,838 | 6/1981 | Frangmeyer | 239/223 |
| 4,505,430 | 3/1985 | Rodgers | 239/112 |
| 4,643,357 | 2/1987 | Culbertson | 239/112 |
| 4,684,064 | 8/1987 | Kwok | 239/223 |
| 4,838,487 | 6/1989 | Schneider | 239/224 |
| 4,887,770 | 12/1989 | Wacker et al. | 239/224 |
| 4,919,333 | 4/1990 | Weinstein | 239/703 |

FOREIGN PATENT DOCUMENTS

| | | |
|---|---|---|
| 0224052 | 6/1987 | European Pat. Off. . |
| 3001209 | 7/1981 | Fed. Rep. of Germany . |
| 2586206 | 2/1987 | France . |

OTHER PUBLICATIONS

Patent Abstracts of Japan, vol. 6, No. 174 (C-123) [1052], Sep. 8, 1982 & JP-A-57 87 863 (Toyota Jidosha Kogyo K.K.), Jan. 6, 1982.

*Primary Examiner*—Andres Kashnikow
*Assistant Examiner*—Christopher G. Trainor
*Attorney, Agent, or Firm*—Spensley Horn Jubas & Lubitz

[57] ABSTRACT

A centrifugal device for atomizing a coating product comprises a generally bowl-shape rotating member having an inside wall substantially perpendicular to the rotation axis of the rotating member between a drive hub and the interior surface of the bowl. The wall defines within the bowl a front cavity open in the spraying direction and a rear cavity surrounding the hub. A coating product nozzle and a cleaning product nozzle are accommodated in the rear cavity and are both directed towards the wall. Passages are formed at the outside periphery of the wall near the interior surface, and the wall incorporates an annular opening communicating with the rear cavity and within which is defined a reflector surface adapted to reflect some of a jet of liquid towards the central part of the wall. The cleaning product nozzle is oriented towards the reflector surface.

14 Claims, 1 Drawing Sheet

CENTRIFUGAL DEVICE FOR ATOMIZING A COATING PRODUCT, PARTICULARLY FOR APPLICATION BY ELECTROSTATIC SPRAYING

BACKGROUND OF THE INVENTION

1. Field of the invention

The invention concerns a centrifugal device for atomizing a coating product such as paint or varnish, for example a product to be applied by electrostatic spraying; it is more particularly concerned with an improvement to the rotating device enabling it to be cleaned quickly and efficiently.

2. Description of the prior art

A known centrifugal device for atomizing a liquid coating product comprises a bowl-shape member rotating at high speed about its main axis of symmetry. The bowl-shape part is joined to a hub by an internal wall generally perpendicular to the rotation axis. This wall divides the interior of the bowl into two cavities: a front cavity open in the spraying direction and a rear cavity surrounding at least the major part of the hub and in which are arranged, fixed and off-axis relative to said rotating member, a coating product nozzle and a cleaning product nozzle. The two nozzles are directed towards the inside surface of the wall. The wall has passages at its outside periphery (usually a series of small diameter holes arranged in a circle) to enable the coating product to flow as the result of centrifugal force along the inside surface of the bowl until it reaches the edge of the latter where it is atomized to form fine droplets. The rotating member is in principle cleaned by spraying the coating product onto the wall, the cleaning product then following the same path as the coating product to the edge of the bowl.

The front surface of the wall is not wetted by the coating product and should therefore remain clean. However, those skilled in the art know that this front surface gradually becomes covered with viscous droplets of coating product, probably because of the extreme air turbulence which occurs in front of the bowl due to its rotation at high speed. These droplets can be propelled by electrostatic forces towards the objects to be coated. They can also be moved by centrifugal force towards the atomizing edge of the bowl, causing large droplets of the coating product to be sprayed onto the object. As a result of this, the deposits on the front surface of the wall eventually cause unacceptable irregularities on the objects to be coated.

Various solutions to this problem have already been put forward. For example, the U.S. Pat. No. 4,275,838 proposes an arrangement in which an external cleaning product nozzle is carried by a mobile member that is retracted during spraying. During cleaning this nozzle is directed towards the front of the bowl. Another proposal (German patent No 30 01 209) is to inject the cleaning product axially at the center of the wall. A further proposal is simply to eliminate the central part and replace it with a divergent hollow frustoconical member at the back of which the cleaning product is injected through a nozzle directed towards the rotating axis. A solution of this kind is described in U.S. Pat. No. 4,684,064, for example. A different proposal is to make the central part of the wall generally convex and to direct onto this part, through passages that converge towards the front, a jet of cleaning product oriented towards the rotation axis. This solution is described in U.S. Pat. No. 4,505,430.

These devices are relatively inefficient and/or characterized by high cost and complexity.

The invention proposes a new type of centrifugal device for atomizing a coating product which is noteworthy because the shape of the rotating member, and specifically the shape of the aforementioned wall, makes it possible to divide the jet of cleaning product into a number of parts flowing in different directions, enabling all surfaces of the bowl to be cleaned, and in particular all of the front surface of the wall.

SUMMARY OF THE INVENTION

The present invention consists in a centrifugal device for atomizing a coating product comprising a generally bowl-shape rotating member having an inside wall substantially perpendicular to the rotation axis of said rotating member between a drive hub and the interior surface of said bowl, said wall defining within the bowl a front cavity open in the spraying direction and a rear cavity surrounding said hub, in which device a coating product nozzle and a cleaning product nozzle are accommodated in said rear cavity and are both directed towards the wall, passages are formed at the outside periphery of said wall near said interior surface, wherein said wall incorporates an annular opening communicating with said rear cavity and within which is defined a reflector surface adapted to reflect some of a jet of liquid towards the central part of said wall and said cleaning product nozzle is oriented towards said reflector surface.

The reflector surface mentioned above is a generally concave surface with the concave side facing towards the aforementioned rear cavity and its central part discharging into the front cavity. The reflector surface may be frustoconical, for example. With this arrangement some of the cleaning product is reflected towards the central part of the wall consisting essentially of the end of the hub by which the rotating member is fixed to the end of a shaft rotating at high speed. Some other of cleaning product projected onto said reflector surface travels to the edge of the orifice through which the annular opening discharges into said front cavity, so cleaning the radially outermost part of the front surface of the wall. All of the front surface of the wall is therefore cleaned efficiently.

The invention will be better understood and other advantages of the invention will emerge more clearly from the following description of a centrifugal device in accordance with the invention for atomizing a coating product given by way of non-limiting example only and with reference to the appended diagrammatic drawing.

DETAILED DESCRIPTION OF THE INVENTION

Figure 1:
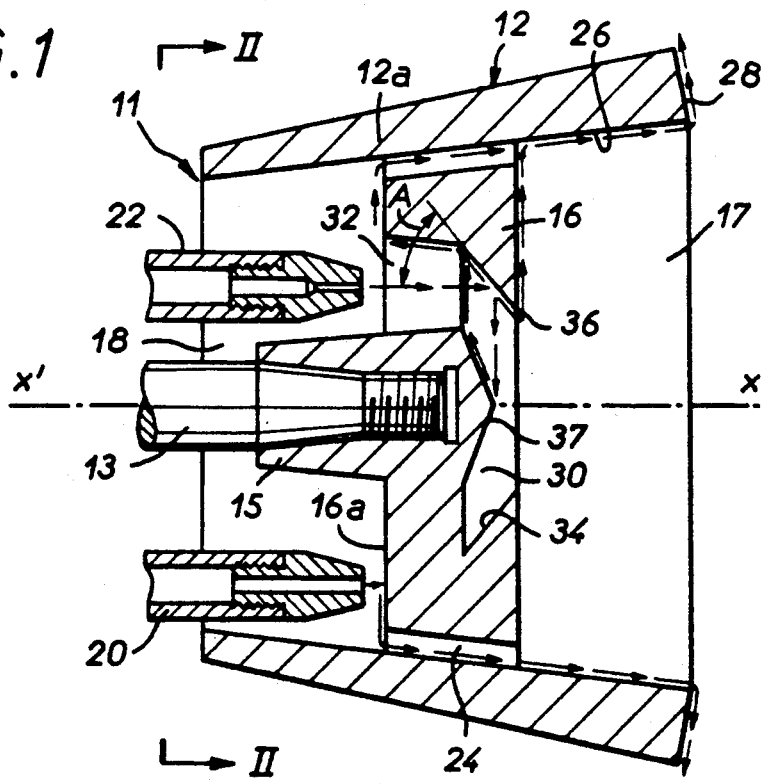
FIG. 1 shows an atomizing device in accordance with the invention in cross-section on the line I—I in FIG. 2.
Figure 2:
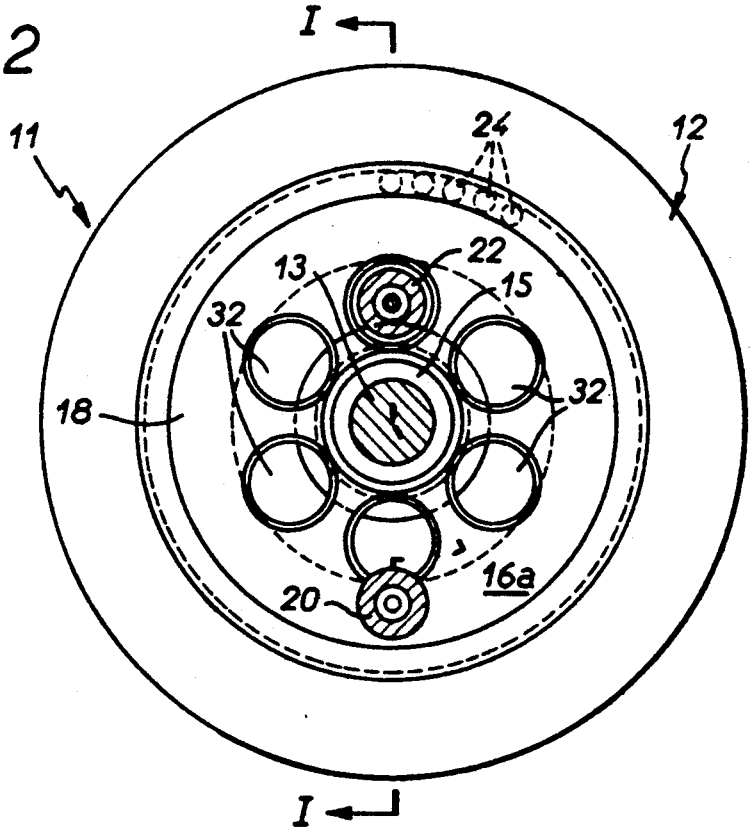
FIG. 2 is a cross-section on the line II—II in FIG. 1.

The drawing shows the rotating member 12 of a centrifugal atomizing device 11 for electrostatic application of a coating product which is generally bowl-shape, has frustoconical walls and is rotated about its main axis of symmetry x'x on a shaft 13 rotated at high speed by drive means (not shown) such as a turbine, for example. The rotating member includes an axial hub 15 fixed to the shaft 13 and the bowl 12*a* constituting its part is joined to the hub by an interior wall 16 substantially perpendicular to the axis x'x. This wall therefore divides the interior of the bowl into a front cavity 17 open in the direction in which the coating product is sprayed and a rear cavity 18 open towards the rear of the device and surrounding the hub 15 and the shaft 13. The rear cavity 18 also accommodates a coating product nozzle 20 and a cleaning product nozzle 22. These two nozzles are fixed relative to the rotating member and are both directed towards the wall 16. The latter comprises small diameter holes 24 at its periphery near the point at which it merges with the inside surface 26 of said bowl 12*a*. As the surface 26 diverges in the spraying direction, the coating product leaving the nozzle 20 impinges on the interior surface 16*a* of the wall 16 and forms a film flowing towards the holes 24, flows through these holes and then flows over the surface 26 to the atomizing edge. 28 from which it is sprayed in fine droplets towards an object to be coated. The two nozzles 20 and 22 are off-axis but parallel to the axis x'x. The nozzle 20 is further from the axis x'x than the nozzle 22. The outlet diameter of the nozzle 22 is smaller than that of the nozzle 20; this arrangement is preferable, but identical nozzles can be used.

The wall 16 incorporates an annular opening 30 communicating with the rear cavity 18 through holes 32 regularly spaced along a circular contour centered on the axis x'x. The opening 30 is shaped to define a reflector surface 34 adapted to direct part of a jet of liquid towards the end part 37 of the hub 15, which is coincident with the central part of the wall. The cleaning product nozzle 22 is oriented towards this surface so that, during cleaning, said cleaning product is sprayed onto said reflector surface through the holes 32.

The reflector surface 34 is a generally concave (in this example substantially frustoconical) surface the concave side of which faces towards said rear cavity 18. Its central area discharges into the front cavity 17 through a wide circular orifice 36. The end of the hub 15 is slightly set back in the axial direction from the plane of the orifice 36. Its front surface is conical. The hub 15 is slightly frustoconical, its diameter increasing from the rear towards the front. Liquid deposited onto the lateral surface of the hub is therefore caused to flow by centrifugal force in the direction away from the axis x'x (i.e. towards the front), protecting the shaft 13 from soiling. The holes 32 are also frustoconical and oriented so that their larger diameter orifices discharge into the rear cavity 18. The holes 32 advantageously have the same cone angle as the hub 15, so that they can be bored as close as possible to the lateral surface of the hub, tangentially to its frustoconical lateral surface. With the reflector surface as described, it is preferable for the axis along which the cleaning product is ejected from the nozzle 22 to have a significant angle of incidence where it impinges on the reflector surface 34. This "angle of incidence" is the angle A between the nozzle axis and the generatrix of the reflector surface at the point of impact. This angle of incidence is preferably between 30° and 60°. The half-angle at the apex of the frustoconical surface 34 is between 15° and 75°, preferably between 30° and 60°. In the example shown, the angle of incidence A and the half-angle at the apex of the frustoconical surface 34 are both approximately 45°.

The flow speed of the cleaning liquid jet, in other words the ratio between the flowrate of the liquid and the cross-section at the outlet of the nozzle 22, is between 15 and 50 m/s. Conventionally, the rotation speed of the rotating member can be anywhere between relatively widely spaced limits, between 6,000 and 60,000 RPM. It is preferably greater than 20,000 RPM.

The device just described operates in the manner now to be described.

During spraying, the coating product is ejected at a design speed from the nozzle 20 and impinges on the surface 16*a* of the wall 16. As explained above, as the result of centrifugal force it flows towards the atomizing edge 28 through the holes 24 at the periphery of the wall 16.

When the rotating member 12 is to be cleaned, the supply of coating product is cut off and cleaning product is ejected at a selected speed from the nozzle 22 towards the wall 16. Where it is not intercepted by the lateral walls of the holes 32 or the surface 16*a* between these holes, the jet of cleaning liquid impinges on the reflector surface 36 and the cleaning liquid is divided between the conical part 37 of the hub and all parts of the wall 16. The cleaning liquid also flows through the holes 24. All of the cleaning liquid eventually flows along the frustoconical wall 26 to the atomizing edge 28.

It may be assumed that the cleaning liquid impinging on the reflector surface 36 is divided into a number of streams. A first stream, subject to relatively little rotation, is reflected by the surface 36 towards the end part 37 of the hub. The cleaning liquid impinging on the central part of the wall would then flow due to the effect of centrifugal force along the conical end portion 37 before being ejected radially outwards, within the thickness of the wall. Another stream, also subject to relatively little rotation, flows towards the orifice 37 as a result of the force with which it is ejected from the nozzle 22. This stream then flows along the front surface of the wall 16 and then along the frustoconical surface 26. Finally, a rotating third stream flows in the thickness of the wall in the direction towards the larger diameter due to the axial component of centrifugal force. This stream then flows to the rear through the holes 32 and spreads radially along the surface 16*a* of the wall 16 before passing through the holes 24 towards the atomizing edge 28. In this way all parts of the bowl are treated with the cleaning liquid, and in particular all of the front surface of the wall.

I claim:

1. Centrifugal device for atomizing a coating product comprising a generally bowl-shaped rotating member having an exterior part in the form of a bowl and an interior surface, and an inside wall substantially perpendicular to the rotation axis of said rotating member, said wall being located between a drive hub and the interior surface of said bowl, said wall defining within the bowl a front cavity open in a spraying direction and a rear cavity surrounding said hub, said device further comprising a coating product nozzle and a cleaning product nozzle accommodated in said rear cavity, both said nozzles being directed towards the wall, passages being formed at the outside periphery of said wall near said interior surface, wherein said wall incorporates an annular opening communicating with said rear cavity and within which is defined a generally concave reflector surface having a concave side facing toward said rear cavity and a central area discharging into said front cavity, said reflector surface being adapted to reflect some of a jet of liquid towards a central part of said wall and said cleaning product nozzle is oriented towards said reflector surface.

2. Device according to claim 1 characterized in that said generally concave surface is substantially frustoconical.

3. Device according to claim 1 wherein said annular opening communicates with said rear cavity through holes equi-angularly spaced in the circumferential direction.

4. Device according to claim 3 wherein said holes are frustoconical, their larger diameter orifices discharging into said rear cavity.

5. Device according to claim 1 wherein said hub is frustoconical, its diameter increases from the rear towards the front.

6. Device according to claim 1 wherein the axis of said cleaning product nozzle is substantially parallel to the rotation axis of said rotating member.

7. Device according to claim 1 wherein the angle of incidence between the axis of said coating product nozzle axis and said reflector surface is between 30° and 60°.

8. Device according to claim 2 wherein the halfangle at the apex of the frustoconical surface is between 15° and 75°.

9. Device according to claim 2 wherein the halfangle at the apex of the frustoconical surface is between 30° and 60°.

10. Device according to claim 2 wherein the angle of incidence between the cleaning product nozzle axis and the generatrix of the reflector surface at the point of impact and the half-angle at the apex of the frustoconical surface are approximately 45°.

11. Device according to claim 1 wherein the flow speed of the cleaning liquid jet is between 15 and 50 m/s.

12. Device according to claim 1 wherein the rotation speed of said rotating member is between 6,000 and 60,000 RPM.

13. Device according to claim 12 wherein the rotation speed of said rotating member is greater than 20,000 RPM.

14. Centrifugal device for atomizing a coating product comprising a generally bowl-shaped rotating member having an exterior part in the form of a bowl and an interior surface, and an inside wall substantially perpendicular to the rotation axis of said rotating member, said wall being located between a drive hub and the interior surface of said bowl, said wall defining within the bowl a front cavity open in a spraying direction and a rear cavity surrounding said hub, said device further comprising a coating product nozzle and a cleaning product nozzle accommodated in said rear cavity, both said nozzles being directed towards the wall, passages being formed at the outside periphery of said wall near said interior surface, wherein said wall incorporates an annular opening communicating with said rear cavity and within which is defined a reflector surface adapted to reflect some of a jet of liquid towards a central part of said wall and said cleaning product nozzle is oriented towards said reflector surface, wherein said hub is frustoconical and the diameter of said hub increases in the direction from said rear cavity toward said front cavity.

* * * * *